United States Patent [19]

Engelhardt

[11] Patent Number: 4,801,113

[45] Date of Patent: Jan. 31, 1989

[54] APPARATUS AND METHOD FOR ELECTRICAL HEATING OF AIRCRAFT SKIN FOR BACKGROUND MATCHING

[75] Inventor: Michel Engelhardt, Brooklyn, N.Y.

[73] Assignee: Grumman Aerospace Corporation, New York, N.Y.

[21] Appl. No.: 100,775

[22] Filed: Sep. 24, 1987

[51] Int. Cl.[4] ..... B64D 45/00

[52] U.S. Cl. ..... 244/121; 244/1 R; 89/36.01; 250/354.1

[58] Field of Search ..... 244/1 R, 121; 89/36.01, 89/36.12; 250/342, 352

[56] References Cited

U.S. PATENT DOCUMENTS

| | | | |
|---|---|---|---|
| 1,550,524 | 8/1925 | Eremeeff | 219/202 |
| 2,300,067 | 10/1942 | Schwab | 89/36.12 |
| 3,086,202 | 4/1963 | Hopper et al. | 343/18 |
| 3,127,608 | 3/1964 | Eldredge | 343/18 |
| 3,227,879 | 1/1966 | Blau et al. | 250/84 |
| 3,509,568 | 4/1970 | Manning et al. | 343/18 |
| 3,978,342 | 8/1976 | Hagen et al. | 250/495 |
| 4,240,212 | 12/1980 | Marshall et al. | 434/11 |
| 4,292,502 | 9/1981 | Adams | 219/483 |
| 4,302,068 | 11/1981 | Tyroler | 350/1.1 |
| 4,413,668 | 11/1983 | Allard | 165/1 |
| 4,422,646 | 12/1983 | Rosa | 273/348.1 |
| 4,463,653 | 8/1984 | Pusch et al. | 60/39.5 |
| 4,546,983 | 10/1985 | Rosa | 273/348.1 |
| 4,609,034 | 9/1986 | Kosson et al. | 250/352 |

FOREIGN PATENT DOCUMENTS

| | | | |
|---|---|---|---|
| 2848072 | 5/1980 | Fed. Rep. of Germany | 89/36.01 |

*Primary Examiner*—Galen Barefoot
*Assistant Examiner*—Rodney Corl
*Attorney, Agent, or Firm*—Scully, Scott, Murphy & Presser

[57] ABSTRACT

Apparatus and method for background matching of an aircraft or spacecraft which includes the direct electrical heating of the aircraft skin to minimize a negative infrared contrast signature detected from above platform infrared detectors. An infrared detector on the bottom of the aircraft detects the background radiance which is compared with the aircraft radiance determined from the power flight conditions or from direct sensors. An on board computer compares the background and aircraft radiance to determine the amount of heat required to match the background. The computer controls a power source that heats an electrical resistor within the aircraft skin to increase the skin temperature. Selective heating of portions of the aircraft skin may be provided by a plurality of resistors strategically placed on the aircraft fuselage.

41 Claims, 3 Drawing Sheets

APPARATUS AND METHOD FOR ELECTRICAL HEATING OF AIRCRAFT SKIN FOR BACKGROUND MATCHING

BACKGROUND OF THE INVENTION

1. Field of the Invention

This invention relates to aircraft infrared background matching in which the upper surface of an aircraft skin is electrically heated to provide an infrared contrast signature matching the earth background.

2. Background of the Invention

An aircraft in flight is generally susceptible to detection from above by an infrared (IR) sensor that senses the contrast in temperature between the earth background and the aircraft skin. Aircraft operate at different power settings, such as, cruise, military and afterburner while on a mission and each setting dictates different power flight conditions. The power conditions include velocity, altitude and power, which affect the temperature of the aircraft skin resulting in an aircraft IR signature.

The power flight conditions for an aircraft flying at cruise include high altitude and low Mach number. Mach number is the ratio of velocity to the speed of sound. During this setting, the aircraft skin approaches the relatively low temperature of the surrounding atmosphere. Consequently, when viewed from an above platform, such as missles, aircraft and spacecraft, the subject aircraft will be flying over the relatively warmer earth background resulting in a negative IR contrast signature. The aircraft will them become susceptible to detection by an IR detection system employed on the above platform. The negative IR contrast signature arises from the radiance emitted by the aircraft being less than the radiance of the background.

Since aircraft operate the majority of the time in cruise, it is desirable to provide a means for matching the IR signature of the aircraft upper skin with the associated terrain and sky background to minimize the contrast signature and thereby reduce the possibility of detection by an IR sensor.

One prior art method of background matching is disclosed in German Patent No. 2848072 wherein a radiometer is used to measure parameters such as temperature, visibility and cloud cover above an object in order to determine the background radiance. The background radiance is then used to control a microwave source incorporated in the object to provide an output that, coupled with the microwave radiation of the object, matches that reflected by the sky within the visibility range. The matching of the microwave background radiation system would not be suitable for contrast matching of an aircraft in flight where the aircraft and background radiance are continually changing.

U.S. Pat. No. 4,413,668 discloses use of forced air passing over the outer surface of an object to reduce the temperature and thus the thermal signature of the object. Air entrainment channels are attached to the surface of the object and together with multi-layered suppressors collect and expel the heat emanating from the object. The system would probably be too bulky and costly to be suitable for use on an aircraft.

SUMMARY OF THE INVENTION

The present invention is directed to a background matching system wherein the radiance emanating from the upper skin of an aircraft is matched to the background radiance emanating from below the aircraft to provide a substantially zero contrast signature to an above platform infrared sensor.

The upper skin of the aircraft is automatically heated by electrical resistor means coupled to the skin to match the radiance of the background and avoid detection. The invention includes an infrared detector attached to the bottom of the aircraft for determining the earth background radiance. The sensor converts the radiance to an electrical signal that is fed to a computer on board the aircraft. The power flight conditions, as determined from the aircraft navigation system are inputted to the computer which determines the aircraft skin radiance. The aircraft skin radiance may also be determined by providing a thermocouple at strategic locations on the aircraft skin that will convert the heat to an electrical signal that is sent to the computer. The computer compares the background radiance with the aircraft radiance to determine the presence of a negative contrast signature. The computer then determines the amount of heat required to match the background and the power necessary to heat the resistor to provide the background matching. The computer sends a control signal to an on board power generator to provide the proper amount of power to the resistor.

The electrical resistor means contemplated includes a wire mesh coupled to the bottom of the skin of a metallic aircraft or embedded within the skin of an aircraft made from composite materials. In one embodiment, the resistor mesh is located at several strategic locations throughout the aircraft skin and the computer provides selective heating of the various resistors in accordance with the requirements to match the background radiance at each location. In this embodiment, a plurality of thermocouples are placed at the detection locations, each sending signals back to the computer to determine the power necessary to heat each of the resistors.

DETAILED DESCRIPTION OF THE INVENTION

Figure 1:
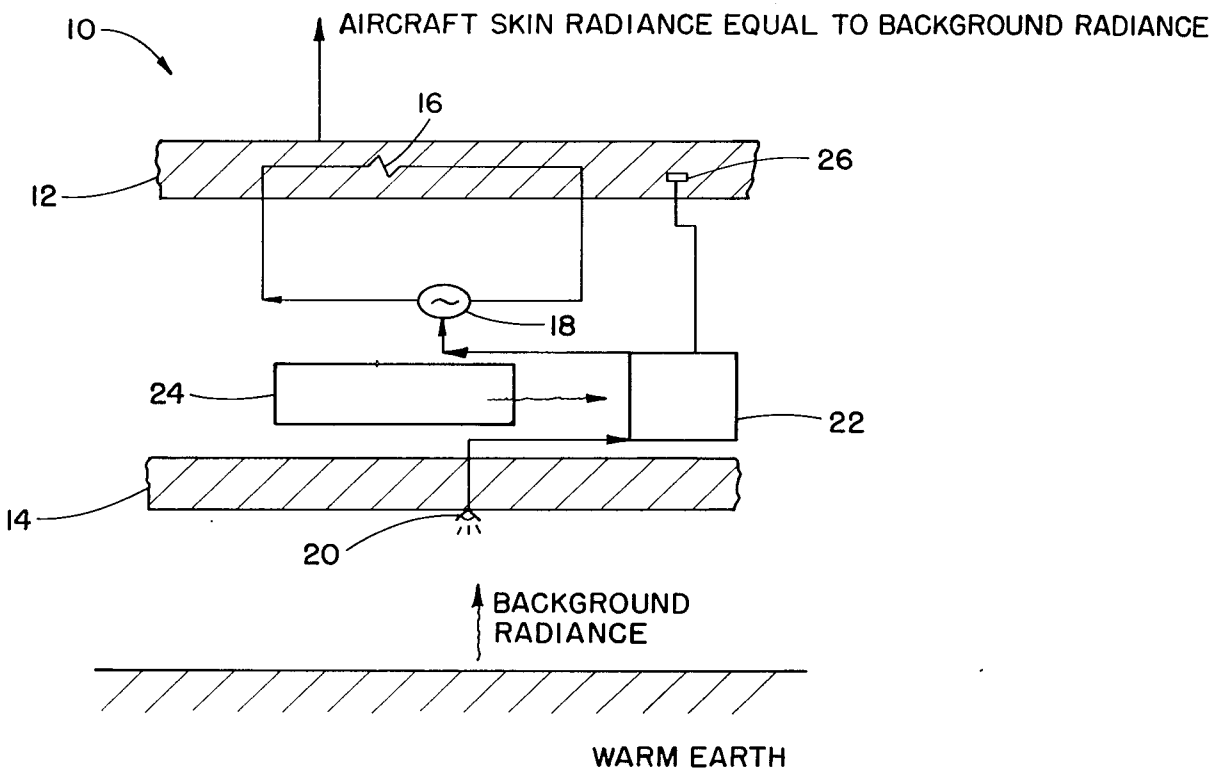
FIG. 1 is a schematic diagram of the background matching system of the present invention.

Referring to the drawings, FIG. 1 shows a schematic diagram of the system 10 of the present invention wherein the top or upper skin of the aircraft fuselage is indicated at 12 and the bottom is indicated at 14. A resistor means 16 is shown as being embedded within the aircraft skin which would be operative when the aircraft is made of composite materials. Alternatively, the resistor means 16 is coupled to the bottom surface of the aircraft skin made of metallic materials. An on board power source 18 is coupled to the resistor means 16 for providing the necessary current to the resistor to heat the aircraft skin. The electrical power may be provided from the gas turbine generator bus bar station or one or more additional electrical generators dedicated to heating the aircraft skin.

An infrared detector 20 is provided on the bottom surface of the aircraft to detect the background radiance emanating from the earth. A control means 22, such as an on board computer, receives the signals from the infrared detector 20 and compares the background radiance with the radiance of the aircraft. The control means 22 determines the aircraft radiance from the power flight conditions such as the Mach number, altitude and velocity, which are obtained from the aircraft navigation system 24. Alternatively, the aircraft radiance may be determined by placing at least one thermocouple 26 on or within the aircraft skin at a detection location proximate the resistor. The thermocouple 26 produces electrical signal in response to the surrounding heat from which the computer determines the aircraft radiance.

The control means 22 receives the signals from the infrared sensor 20 and from either the navagation system 24 or the thermocouple 26 and computes both the aircraft radiance and the background radiance. In response to a negative contrast signature, which will result when the aircraft radiance is less than the background radiance, the control means determines the amount of heat required to heat the aircraft to match the background radiance. The control means then determines the amount of power needed to be applied to the resistor 16 in order to provide the necessary heat. The control means 22 thereafter sends a control signal to the power source 18 to generate the necessary heat. The background and aircraft radiance will be continually monitored during the flight mission of an aircraft to automatically adjust the power applied to the resistor to maintain the background matching. Thus, during the entire mission, the aircraft radiance will be matched with the background radiance to minimize detection by an above platform infrared detector.

Figure 2A:
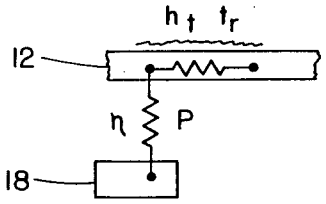
FIG. 2*a* is a schematic diagram of the heating system showing certain heating parameters.
Figure 2:
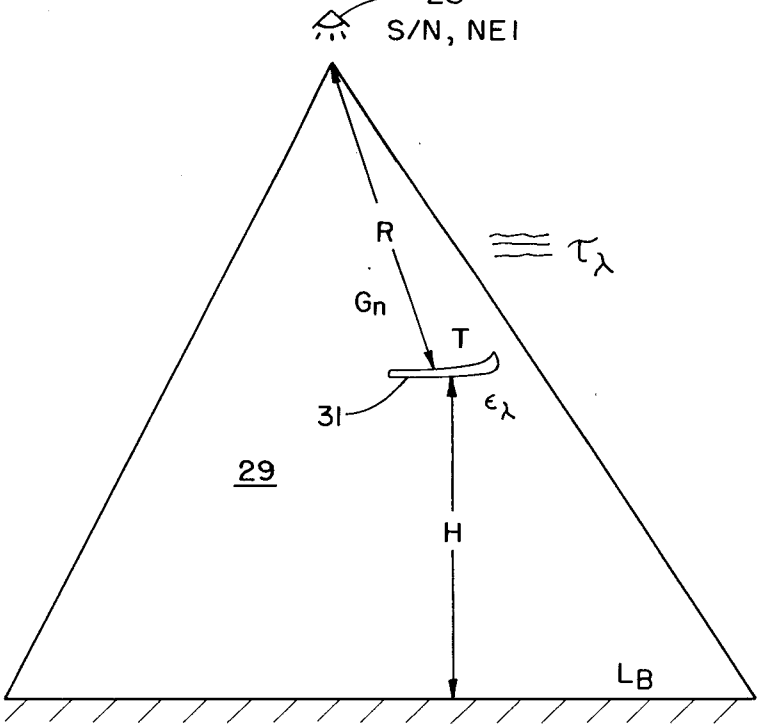
FIG. 2 is a schematic diagram of the field of view of a look-down IR platform showing certain detection parameters.

The following is a description of the governing equations necessary to determine the IR contrast signature and the required power to provide background matching. FIG. 2 shows an upper IR detection electro-optical sensor 28 having a detection field of view 29 extending between the sensor 28 and the earth. An aircraft 31 is depicted within the field of view 29 at a detection range R and an altitude H. The aircraft IR detection from the upper IR detection platform 28 is calculated by the range equation, $$R^2 = \frac{I_c}{S/N * NEI} \tag{1}$$

where

R = Detection range $I_c$ = IR contrast signature

S/N = Signal-to-noise of the electro-optical system

NEI = Noise equivalent irradiance of the electro-optical system

The IR contrast signature is defined as the difference between total target intensity (source plus reflected intensities) and the occulted background, $$I_c = \int_{\lambda_1}^{\lambda_2} \left[ I_{T,\lambda} - (L_{B,\lambda} - L_{F,\lambda}) \sum_{n=1}^{N} G_n \right] d\lambda \tag{2}$$

where $I_{T,\lambda}$ = Spectral target intensity (sum of all emitted and reflected target radiance components as attenuated by the atmosphere)

$L_{B,\lambda}$ = Spectral background radiance (radiance between the observer and the limit of his field of view)

$L_{F,\lambda}$ = Spectral foreground radiance (radiance between the observer and the target)

$G_n$ = Target (or aircraft) projected area (projected in the observer's field of view)

The target intensity $I_{T,\lambda}$, in simple terms, may be defined as the equivalent to the radiance $L_\lambda$ multiplied by the projected area of the aircraft $G_n$ in the sensor's field of view.

To reduce the observable range, the IR contrast signature must be minimized. In Equation (2), if the target intensity, $I_{T,\lambda}$, is increased such that the difference between the $I_{T,\lambda}$ and the background intensity, $$(L_{B,\lambda} - L_{F,\lambda}) \sum_{n=1}^{N} G_n,$$

approaches zero, then from Equation (1) the electro-optical sensor's detection range will be diminished. The amount by which the target intensity approaches the background intensity can be quantified by the expressions which follow:

In Equation (2), the first term on the right hand side, $$\int_{\lambda_1}^{\lambda_2} I_{T,\lambda}\, d\lambda,$$

can be written in terms of its emission and reflection components. Considering thermal radiance from the aircraft skin by Planck's Law, solar diffuse reflection, and sky reflection, this term becomes:

$$\int_{\lambda_1}^{\lambda_2} I_{T,\lambda}\, d\lambda = \int_{\lambda_1}^{\lambda_2} \left[ \tau_{1,\lambda}\, 2C_1\lambda^{-5} \left\{ \exp\left(\frac{C_2}{\lambda T}\right) - 1 \right\}^{-1} * \sum_{n=1}^{N} G_n\, \epsilon_{\lambda,\eta} + \tau_{1,\lambda}\, \tau_{2,\lambda} \frac{E_{s,\lambda}}{\pi} \sum_{n=1}^{N} G_n (1 - \epsilon_{\lambda,\eta}) * (e_s \cdot e_n) + \tau_{1,\lambda}\, R_{us,\lambda} \sum_{n=1}^{N} G_n (1 - \epsilon_{\lambda,\eta}) \right] d\lambda \tag{3}$$

where

T = Target airframe temperature $\tau_\lambda$ = Spectral atmospheric transmittance (sub 1 between the target and the observer, sub 2 between the edge of the atmosphere and the target)

$C_1$ = Planck's first constant $C_2$ = Planck's second constant $E_s$ = Solar irradiance $\hat{e}$ = Unit normal vector (sub s for the sun, sub n for the $n^{th}$ facet)

$R_{us}$ = Atmospheric radiance of the upper sky $\epsilon_{\lambda,\eta}$ = Spectral emissivity of the target $n^{th}$ facet and $$L_\lambda = \frac{2C_1}{\lambda^5\left\{\exp\left(\frac{C_2}{\lambda T}\right) - 1\right\}}$$

The target airframe temperature, T, is determined by the readings obtained from the thermocouple in the aircraft skin or from the power flight conditions supplied by the navigation system.

In Equation (3), the plume intensity has not been considered since plume emission is centered around 2.7 and 4.3 micrometers and the subject invention is concerned only with look-down sensor capabilities operating in the thermal region (8 to 12 micrometers). When plume water vapor emission in the 8 to 12 micrometer band is significant, then a plume intensity term must be added to Equation (3).

The electrical power required to reduce the negative contrast can be computed from an energy balance (see FIG. 2a), $$P = h_T(T - T_r)^* A/\eta \tag{4}$$

where $h_T$=Sum of the convective and radiative heat transfer coefficients $T_r$=Recovery temperature which is a function of aircraft altitude and Mach number A=Surface area to be heated $\eta$=Conversion efficiency from mechanical to electrical and from electrical to thermal power The total heat transfer coefficient is given by, $$h_r = \frac{Nu\,k}{L} + \frac{\epsilon\sigma(T^4 - T_\infty{}^4)}{T - T_r} \tag{5}$$

where,

Nu=Nusselt number $\sigma$=Stefan-Boltzmann constant

T=Temperature of space k=Thermal conductivity of the air at the target altitude

L=Mean target length

For Re$\leqq 10^7$, $$Nu_L = 0.036\,(Re_L)^{0.8}(Pr)^{1/3} \tag{6}$$

where

Re=Reynold's Number $$\frac{\rho V L}{\mu}$$

V=Target velocity $\rho$=Air density at the target altitude $\mu$=Air viscosity at target altitude temperature Pr=Prandtl Number$\cong$0.7 for air For $10^7 < Re < 10^9$ $$Nu_L = \frac{0.277(Re_L)\,(Pr)^{\frac{1}{3}}}{(\log_{10} Re_L)^{2.584}} \tag{7}$$

To determine the required power, Equations 1 through 7 must be solved as a set of equations. As a means for reducing the complexity of these equations, the analytical method which follows provides insight to the required power needed for heating and can be used for preliminary design.

As a first order approximation to the reduction in detection range through electrical heating consider the following assumptions:

1. Constant atmospheric transmittance between the aircraft and the sensor in the 8 to 12 micrometer band. This assumption is reasonable since there are not major absorption spikes (except for a minor spike at about 9 micrometer due to ozone).

2. No solar reflections. Solar reflections above 4 micrometers can be neglected since the solar energy contained above 4 micrometers is significantly less than the thermal energy emitted by the aircraft.

3. Constant spectral emittance ($\epsilon_{\lambda,n}$) over the wavelength range $\lambda_1$, $\lambda_2$.

4. No sky reflections. Sky reflections are usually neglected from IR radiation calculations since they are relatively insignificant compared to thermal energy emitted by the aircraft. (Sky reflections tend to enhance the thermal signal by values ranging from negligible to less than approximately ten percent.)

Using the above assumptions in Equations 1 through 5, the reduction in detection range can be derived as, $$\Gamma = \frac{En\,[1 + Po]^4 - 1}{En - 1} \tag{8}$$

where the dimensionless quantities are defined as follows:

The Reduction in Detection Range Ratio $$\Gamma = \frac{R^2}{R_o{}^2} \tag{9}$$

where

R=Observer's range capability with aircraft electrical power on $R_o$=Observer's range capability without aircraft electrical power The Dimensionless Energy Ratio $$En = \frac{\tau_1\,(C_3)\,T_\Gamma{}^4\,\Delta F\,\sum_{n=1}^{N} G_n\,\epsilon_{\lambda,n}}{\sum_{n=1}^{N} G_n \int_{\lambda_1}^{\lambda_2} (L_{B,\lambda} - L_{F,\lambda})d\lambda} \tag{10}$$

where $$C_3 = \frac{C_1}{C_2{}^4}$$

$$\Delta F = \sum_{m=1}^{\infty} m^{-4}\,\{\exp(-m\,X_2)\,[(m\,X_2)^3 + 3\,(m\,X_2)^2 + 6(m\,X_2) + 6] - \exp(-m\,X_1)\,[(m\,X_1)^3 + 3\,(m\,X_1)^2 + 6(m\,X_1) + 6]\} \tag{11}$$

$$X_1 = \frac{C_2}{\lambda_1\,T} \tag{12a}$$

$$X_2 = \frac{C_2}{\lambda_2\,T} \tag{12b}$$

The Dimensionless Power Ratio $$Po = \frac{\eta P}{A\, h_T\, T_r} \tag{13}$$

From Equation (8), for r=0, the power required is given by, $$Po = \frac{1}{En^{\frac{1}{4}}} - 1$$

For En>1 (corresponding to a positive contrast signature), Po must be less than zero—indicating that cooling is required. This is not the case of interest here.

For En>1, corresponding to negative contrast, Equation (14) gives the electrical power required for r=0.

In Equation (8), the dimensionless power ratio, Po, can be solved in terms of the desired reduction range ratio and the dimensionless energy ratio, $$Po = \left[\frac{\Gamma(En - 1) + 1}{En}\right]^{\frac{1}{4}} - 1 \tag{15}$$

This results in an equation used to compute the required electric power to provide a desired observer detection range reduction, $$P = \frac{Ah_T\, T_r}{\eta}\left\{\left[\frac{\Gamma(En - 1) + 1}{En}\right]^{\frac{1}{4}} - 1\right\} \tag{16}$$

From Equation (10), the following results can be conceived:

Case 1

En>>1: The observed aircraft is in a positive contrast mode which is predominant at low altitude and supersonic speeds.

Case 2

En=1: The aircraft cannot be observed. This is a special case which can be forced to occur by choice of flight conditions.

Case 3

0<En<<1: The observed aircraft is in a negative contrast mode which is predominant at high altitude and subsonic speeds. Note that in Equation (10), $L_{B,\lambda}$ is greater than $L_{F,\lambda}$. Case 3 relates to the subject of this invention.

From Equations (8) and (13), the following results can be described:

Case 3a

Po=0: The aircraft under observation has no means of reducing its contrast intensity and from Equation (8), this results in no reduction in the observer's range.

Case 3b

Po=1: The power supplied just balances the energy gained or lost by the airframe. Equation (8) is simplified to $$\Gamma = \frac{16En - 1}{En - 1} \tag{17}$$

From, Case 3, En is a fraction less than one and from Equation (17), En must be less than (1/16) to ensure a reduction in detection range.

The use of Equations (8) through (17) allow for an effective analytical method to understand the physics of the problem as well as to provide for simple equations for use in preliminary design.

In Equation (10), under atmospheric conditions which result in low foreground radiance $L_{B,\lambda} >> L_{F,\lambda}$ then $L_{F,\lambda}$ can be set to zero. The background radiance between the aircraft and the background can be measured by an IR sensor at the bottom of the aircraft. Consequently, the integral in the denominator of Equation (10) can be expressed as $$D = \left[\frac{\int_{\lambda_1}^{\lambda_2} L_{B,\lambda}\, d\lambda}{H^2}\right] H^2 \tag{18}$$

where, H=Target altitude

For use in electric heating, the denominator, (En−1), in Equation (8), should always yield a negative quantity. For the numerator in Equation (8) (with the negative denominator), the following cases are considered:

Case 3c

En[1+Po]$^4$−1>0: Too much power has been added. A reduction in power is required when used in a control loop.

Case 3d

En[1+Po$^4$]−1=0: Optimum contrast is obtained $$Po = \left[\frac{1}{En} - 1\right]^{\frac{1}{4}} \tag{19}$$

In Equation (19), as En increases, the power required decreases.

Case 3e (En−1) En(1+Po$^4$)<0: The power added will reduce the detection range.

As stated previously, an aircraft operates in three basic power settings, cruise, military and afterburner. During ninety percent of the mission, the aircraft is in the cruise setting in which the Mach number is 0.9 or less. Higher Mach numbers which are attained during military or afterburner settings will minimize the contrast signature. An aircraft will generally be in a high Mach number setting for only a very short period of time. The aeroheating of an aircraft flying at a high Mach number will be automatically increased, resulting in a cross-over to a positive contrast signature. While there is one particular Mach number corresponding to a zero contrast signature, it is not practical to have an aircraft fly at a particular high Mach number at all times merely to match the background. The increase in aircraft Mach number also increases the temperature of the bottom of the aircraft which would make the aircraft susceptible to detection when viewed from a lower platform. Secondly, at higher Mach numbers, the aircraft plume becomes more dominant, again rendering the aircraft more susceptible to detection. Further, if the aircraft is intentionally flying at a higher Mach number for camouflage considerations, the increased aircraft aerodynamic drag would require the aircraft to burn more fuel thereby reducing the mission range.

Thus, there are significant advantages in providing direct electrical heating of the aircraft fuselage upper skin to match the background while the aircraft is in either cruise or military power settings. The direct heating provides uniform temperature throughout the skin of the aircraft which has the added effect of providing reduced thermal cyclic stresses on the aircraft skin prolonging the life cycle of the aircraft. In addition, the desired camouflage from upper infrared detection platforms is provided with minimal weight penalty.

Figure 3:
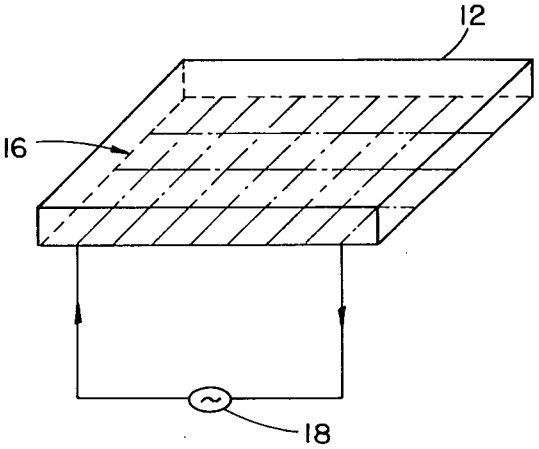
FIG. 3 is a schematic diagram of the resistor heating element.

FIG. 3 shows a schematic diagram of a resistor 16 embedded within the aircraft skin 12. The resistor 16, as shown in FIG. 3, includes a wire mesh that is coupled to the power source 18. It should be understood that the invention is not limited to a wire mesh resistor means, as any suitable resistor design would be acceptable. In order to provide selective heating of different sections of the aircraft, a plurality of resistors 16 may be placed throughout several detection locations on the aircraft skin. In this embodiment, each detection location would have a thermocouple connected to the computer 22. Although only one resistor and thermocouple are shown in FIG. 1, it is understood that a plurality may be provided. The computer then selectively computes the power for each resistor and sends a control signal to provide the necessary current to each of the resistors. A separate power circuit would be required for each resistor. The computer produces output signals on a plurality of channels in response to the existence of a negative contrast signature at each location. In this embodiment, different sections of the aircraft may be selectively heated in order to have uniform background matching. For a typical aircraft, only certain sections of the upper skin would require additional heating since on different missions some skin sections would be heated due to internal heat dissipation by, for example, engines, anticers, heat exchanger dumps, etc.

The infrared detectors used in the above platforms have a detection band in the 8 to 14 μm wavelength range. In the 8 to 14 μm band only the fuselage heat will be detected as all other heat sources in the aircraft such as the engine and plume give off heat in lower wavelength bands. In addition, the atmospheric transmittance is higher in the 8 to 14 μm band. Moreover, the fuselage is cooler when compared with the radiance emitted from the surrounding earth, cloud and sky resulting in a negative contrast signature, thereby being more easily detected by an infrared sensor. Thus, it is only necessary that the heating resistors be placed in the skin of the fuselage.

Figure 4:
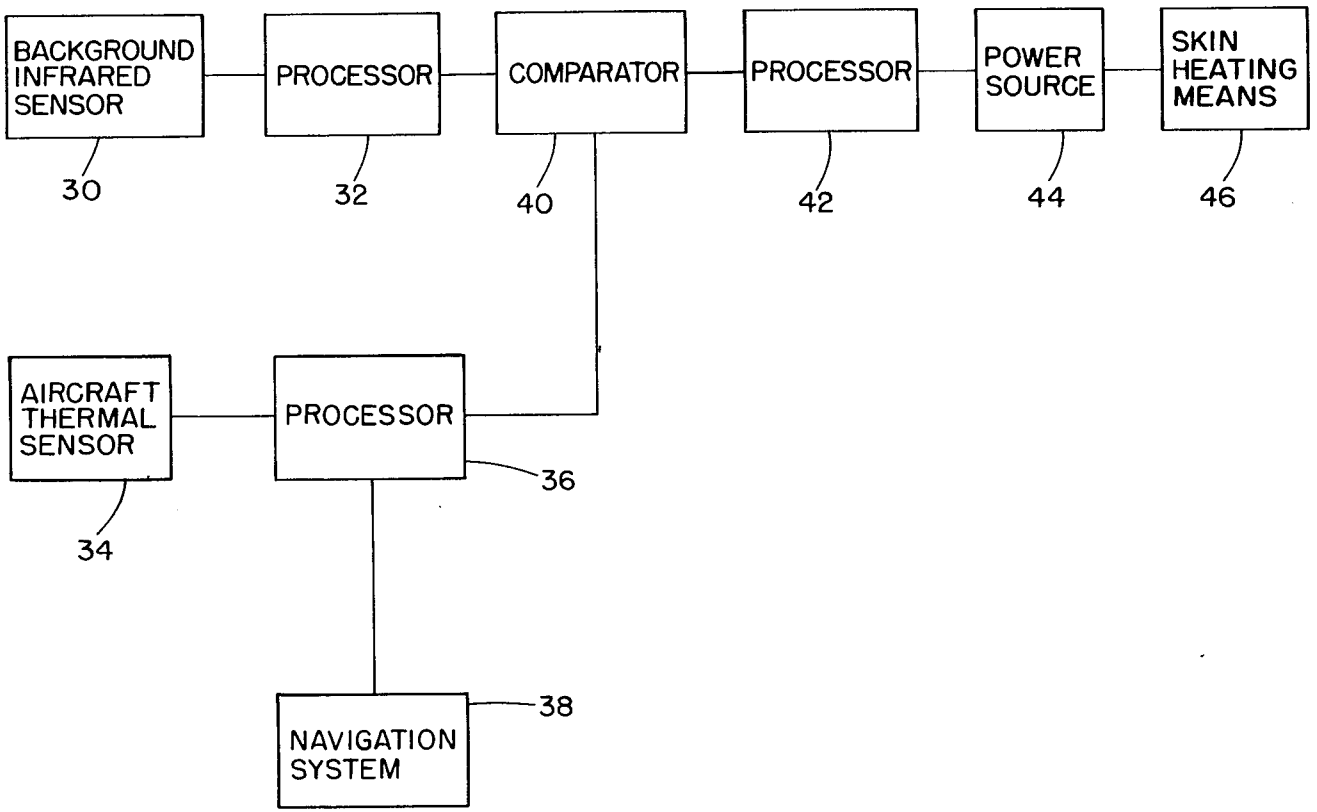
FIG. 4 is a block diagram of the background matching system of the present invention.

FIG. 4 shows a block diagram of the elements of the background matching system of the present invention. The Infrared sensor 30 detects the radiance emanating from the earth and surrounding atmosphere below the aircraft. The sensor 30 produces an electrical output signal representative of the background radiance that is inputted to processor 32. A thermal sensor 34 detects the temperaure of the aircraft skin and produces an electrical output signal that is inputted to processor 36 which computes the aircraft radiance. In the alternative, the navigation system 38 will be coupled directly to processor 36 which computes the aircraft skin radiance from the power flight conditions. Processors 32 and 36 produce output data representative of the background radiance and aircraft radiance respectively and inputs this data to comparator 40. Comparator 40 compares the output data from each of the processors 32 and 36 and produces an output signal in response to the aircraft skin radiance being less than the background radiance. This output signal is inputted to processor 42 which computes the required electrical power needed to heet the aircraft skin for background matching. The processor 42 sends a control signal to the power source 44 which generates the required current to heat the skin heating means 46.

While illustrative embodiments of the subject invention have been described and illustrated, it is obvious that various changes and modifications can be made therein without departing from the spirit of the present invention which should be limited only by the scope of the appended claims.

I claim:

1. A system for matching the radiance of the upper skin of an aircraft to the background radiance emanating from below the aircraft, said system comprising:

first means for sensing the radiance of the aircraft upper skin;

second means for sensing the background radiance emanating from below the aircraft;

electrical resistor means coupled to the aircraft skin for directly heating the aircraft upper skin;

control means coupled to said first and second sensing means for comparing the background radiance with the aircraft upper skin radiance and for determining the magnitude of the electrical power required to heat the upper aircraft skin sufficient to increase the aircraft radiance to match the background radiance, said control means producing a control signal for generating the required electrical power; and electrical power means coupled to said control means for providing said required magnitude of electrical power to said electrical resistor means in response to said control signal thereby matching the aircraft radiance with said background radiance.

2. The system of claim 1 wherein said first means for sensing the aircraft upper skin radiance includes a navigation system for said aircraft.

3. The system of claim 1 wherein said first means for sensing the aircraft upper skin radiance includes a thermocouple coupled to the aircraft upper skin for directly sensing the radiance of said aircraft upper skin.

4. The system of claim 1 wherein said second means for sensing the background radiance includes an infrared detector located on the lower skin of the aircraft for producing an electrical output signal representative of the background radiance.

5. The system of claim 1 wherein said control means includes a computer.

6. The system of claim 1 wherein said electrical resistor means is secured to the bottom of the aircraft upper skin made of metallic materials.

7. The system of claim 1 wherein said electrical resistor means is embedded within the aircraft upper skin made of composite materials.

8. The system of claims 6 or 7 wherein said electrical resistor means is a wire mesh.

9. The system of claim 1 further including a plurality of electrical resistor means coupled to said aircraft upper skin at a plurality of detection locations.

10. The system of claim 9 wherein said means for sensing the aircraft skin radiance includes a plurality of thermal sensors coupled to said aircraft skin proximate to said electrical resistor means.

11. The system of claim 10 wherein said control means compares the background radiance with the aircraft skin radiance at each detection location and produces a control signal on a plurality of output channels to generate the required electrical power to each of said electrical resistor means.

12. A system for matching the radiance of the upper skin of an aircraft to the background radiance emanating from below the aircraft, said system comprising:

means for determining the radiance of said aircraft skin while in flight;

means for determining the background radiance emanating from below said aircraft while in flight;

means for comparing the background radiance with the aircraft skin radiance and producing an output signal representative of a negative contrast signature, said negative contrast signature being present when the aircraft radiance is less than said background radiance;

means for electrically heating the aircraft skin to increase the radiance thereof;

means for determining the magnitude of the electrical power required to heat the aircraft skin sufficient to increase the aircraft radiance to match the background radiance, and means for providing said required magnitude of electrical power to said heating means thereby resulting in a substantially zero contrast signature.

13. The system of claim 12 wherein said means for determining the aircraft skin radiance includes a first processor means coupled to the aircraft navigation system for computing the aircraft skin radiance from power flight conditions determined by said navigation system and for producing output data representative of said aircraft skin radiance.

14. The system of claim 12 wherein said means for determining the aircraft skin radiance includes means coupled to the upper skin of said aircraft for directly sensing the radiance of said aircraft upper skin.

15. The system of claim 14 wherein said means for directly sensing the radiance of the aircraft upper skin includes a thermal sensor coupled to a first processor.

16. The system of claims 13 or 15 wherein said means for determining the background radiance includes an infrared detector located on the lower skin of the aircraft for producing an electrical output signal representative of the background radiance.

17. The system of claim 16 further including a second processor means coupled to said infrared detector for converting said electrical output signal to output data.

18. The system of claim 17 wherein said comparing means includes a comparator coupled to said first and second processors for comparing the output data from each of said first and second processor and for producing an output signal in response to the aircraft skin radiance being less than said background radiance.

19. The system of claim 18 wherein said means for determining the magnitude of the electrical power required to heat the aircraft skin includes a third processor means responsive to the output signal of said comparator for computing the required electrical power and producing a control signal in response to said comparator output signal.

20. The system of claim 19 wherein said means for producing the magnitude of electrical power to said heating means includes an existing aircraft power supply coupled to said third processor means and said heating means.

21. The system of claims 12 or 20 wherein said means for electrically heating said aircraft skin includes an electrical resistor means.

22. The system of claim 21 wherein said electrical resistor means is secured to the bottom of the aircraft skin made of metallic materials.

23. The system of claim 21 wherein said electrical resistor means is embedded within the aircraft skin made of composite materials.

24. The system of claim 22 wherein said electrical resistor is a wire mesh.

25. The system of claim 23 wherein said electrical resistor is a wire mesh.

26. The system of claim 12 wherein said means for heating the aircraft skin includes a plurality of electrical resistor means coupled to said aircraft skin at a plurality of detection locations.

27. The system of claim 26 wherein said means for determining the aircraft skin radiance includes a plurality of thermal sensors coupled to said aircraft skin proximate to said electrical resistor means.

28. The system of claim 27 wherein said means for comparing the background radiance with the aircraft radiance includes a comparator coupled to each of said thermal sensors for comparing the background radiance with the aircraft skin radiance at each location as measured by each thermal sensor and for producing on a plurality of output channels an output signal in response to the existence of a negative contrast signature at each of said detection locations.

29. The system of claim 28 wherein said means for determining the magnitude of the electrical power required to heat the aircraft skin includes a processor means responsive to the plurality of output signals of said comparator for computing the required electrical power for each of said detection locations and for producing a control signal on a plurality of corresponding output channels for generating the required electrical power to each of said electrical resistor means.

30. A method for matching the radiance of the upper skin of an aircraft to the background radiance emanating from below said aircraft, comprising the steps of:

determining the radiance of the aircraft skin;

determining the background radiance emanating from below said aircraft, comparing the background radiance with the aircraft skin radiance and determining the presence of a negative contrast signature, said negative contrast signature being present when said aircraft radiance is less than said background radiance;

determining the electrical power required to heat the aircraft skin sufficient to increase the radiance thereof to match the background radiance; and electrically heating the aircraft skin with the required electrical power resulting in a substantially zero contrast signature.

31. The method of claim 30 including the steps of computing the aircraft skin radiance from power flight conditions taken from the aircraft navigation system.

32. The method of claim 30 including providing said required electrical power to an electrical resistor means coupled to said aircraft skin for heating the aircraft skin.

33. The method of claim 32 including providing a plurality of electrical resistor means for selectively heating a plurality of detection locations.

34. The method of claim 33 including providing a plurality of thermal sensors coupled to said aircraft skin for determining the aircraft skin radiance at said plurality of detection locations.

35. The method of claim 34 including comparing the background radiance with the aircraft skin radiance of each detection location and determining the presence of a negative contrast signature at each said detection location.

36. The method of claim 35 including computing the electrical power required to heat each detection location to increase the radiance thereof to match the background radiance.

37. The method of claim 36 including selectively providing the required electrical power to each of said electrical resistor means.

38. The method of claim 30 wherein the electrical power is determined in accordance with the equation:

$$P = \frac{Ah_T T_r Po}{\eta}$$

where, $h_T$=Sum of the convective and radiative heat transfer coefficients $T_r$=Recovery temperature which is a function of aircraft altitude and Mach number A=Surface area to be heated $\eta$=Conversion efficiency from mechanical to electrical and from electrical to thermal power Po=Dimensionless power ratio.

39. The method of claim 38 wherein the dimensionless power ratio is determined in accordance with the equation:

$$Po = \left[\frac{\Gamma(En - 1) + 1}{En}\right]^{\frac{1}{4}} - 1$$

where, $\Gamma$=Reduction in detection range ratio, and $E_n$=Dimensionless energy ratio.

40. The method of claim 39 wherein the reduction in detection range ratio is determined in accordance with the equation:

$$r = \frac{R^2}{R_o^2}$$

where,

R=Observer's range capability with aircraft electrical power on $R_o$=Observer's range capability without aircraft electrical power.

41. The method of claim 40 wherein the dimensionless energy ratio is determined in accordance with the equation:

$$En = \frac{\tau_1 (C_3)\, T_r^4\, \Delta F \sum_{n=1}^{N} G_n \epsilon_{\lambda,\eta}}{\sum_{n=1}^{N} G_n \int_{\lambda_1}^{\lambda_2} (L_{B,\lambda} - L_{F,\lambda})\, d\lambda}$$

where, $G_n$=Target (or aircraft) projected area (projected in the observers field of view)

$T_r$=Recovery temperature $\tau_1$=Average atmospheric transmittance $$C_3 = \frac{C_1}{C_2^4}$$

$C_1$=Planck's first constant $C_2$=Planck's second constant $L_{B,\lambda}$=Spectral background radiance $L_{F,\lambda}$=Spectral foreground radiance $\epsilon_\lambda$=Spectral emissivity of the target $$\Delta F = \sum_{m=1}^{\infty} \{\exp(-m X_2)[(m X_2)^3 + 3(m X_2)^2 + 6(m X_2) + 6] - \exp(-m X_1)[(m X_1)^3 + 3(m X_1)^2 + 6(m X_1) + 6]\}$$

$$X_1 = \frac{C_2}{\lambda_1 T}$$

$$X_2 = \frac{C_2}{\lambda_2 T}$$

* * * * *

UNITED STATES PATENT AND TRADEMARK OFFICE

CERTIFICATE OF CORRECTION

PATENT NO. : 4,801,113

DATED : January 31, 1989

INVENTOR(S) : Michel Engelhardt

It is certified that error appears in the above-identified patent and that said Letters Patent is hereby corrected as shown below:

Column 1, line 32: "them" should read as --then--

Column 3, line 16: "signal" should read as --signals--

Column 4, line 54: "$(e_s \bullet e_n)$" should read as --$(\hat{e}_s \bullet \hat{e}_n)$--

Column 10, line 12: "heet" should read as --heat--

Column 14, line 40: "$\sum_{m=1}^{\infty}$" should read as --$\sum_{m=1}^{\infty} m^{-4}$ --

Signed and Sealed this

Thirteenth Day of February, 1990

*Attest:*

JEFFREY M. SAMUELS

*Attesting Officer*

*Acting Commissioner of Patents and Trademarks*